US008820828B2

(12) United States Patent
Hayles

(10) Patent No.: US 8,820,828 B2
(45) Date of Patent: Sep. 2, 2014

(54) FOLDABLE ARTIST BENCH

(71) Applicant: Adrian Hayles, Toronto (CA)

(72) Inventor: Adrian Hayles, Toronto (CA)

( * ) Notice: Subject to any disclaimer, the term of this patent is extended or adjusted under 35 U.S.C. 154(b) by 0 days.

(21) Appl. No.: 13/686,172

(22) Filed: Nov. 27, 2012

(65) Prior Publication Data

US 2014/0001795 A1 Jan. 2, 2014

Related U.S. Application Data

(60) Provisional application No. 61/666,130, filed on Jun. 29, 2012.

(51) Int. Cl.
*A47B 83/02* (2006.01)

(52) U.S. Cl.
USPC ..... 297/156

(58) Field of Classification Search
USPC ..... 297/156, 16.2, 31, 195.11, 188.21, 297/188.01
See application file for complete search history.

(56) References Cited

U.S. PATENT DOCUMENTS

| | | | | | |
|---|---|---|---|---|---|
| 3,117,816 | A | * | 1/1964 | De Sena | 297/156 |
| 3,359,928 | A | * | 12/1967 | Gamble | 297/188.01 |
| 3,399,925 | A | | 9/1968 | Levy | |
| 3,907,360 | A | | 9/1975 | Czarnowski | |
| 4,076,348 | A | | 2/1978 | Allison | |
| 4,482,185 | A | * | 11/1984 | Zoellner | 297/135 |
| 5,330,248 | A | * | 7/1994 | Smyly et al. | 297/174 R |
| 5,713,626 | A | * | 2/1998 | Tokarski | 297/171 |
| 5,820,208 | A | * | 10/1998 | Miklinevich | 297/159.1 |
| 6,663,074 | B2 | | 12/2003 | Prior | |

* cited by examiner

*Primary Examiner* — Milton Nelson, Jr.
(74) *Attorney, Agent, or Firm* — Ryan W. Dupuis; Kyle R. Satterthwaite; Ade & Company Inc

(57) ABSTRACT

A foldable artist bench includes a seat panel and first and second legs pivotally coupled to opposing ends of the seat panel so as to be pivotal between a working position and a storage position folded alongside the seat panel. A work support panel is formed integrally with the first leg at one end so as to be foldable therewith into the storage position. The second leg is spaced inwardly from the end of the seat panel such that the work support can be used in multiple operating positions including supporting the seat panel: i) horizontally with the work support upright at one end; ii) upright with the work support similarly upright; or iii) upright with the work support transversely oriented at the top end of the upright seat panel.

17 Claims, 6 Drawing Sheets

FOLDABLE ARTIST BENCH

This application claims the benefit under 35 U.S.C. 119(e) of U.S. provisional application Ser. No. 61/666,130, filed Jun. 29, 2012.

FIELD OF THE INVENTION

The present invention relates to an artist bench of the type typically used by artists in which a work support extends upwardly from one end of a seating surface of the bench to support a work piece of the artist thereon, and more particularly the present invention relates to an artist bench in which legs of the bench and the work support are foldable relative to the seating surface into a substantially flat storage position.

BACKGROUND

A common piece of equipment used by artists is an artist bench which generally includes a horizontal seat panel supported by legs extending downwardly from each of the opposing ends of the seat panel. A work support in the form of an upright panel extends upwardly from one end of the seat panel for supporting a work piece of the artist, for example in place of an easel. To optimally orient the work piece for an artist sitting on the seat panel, the work support is often inclined upwardly and outwardly from the end of the seat panel.

Various examples of artist benches are disclosed in U.S. Pat. No. 6,663,074 by Prior, U.S. Pat. No. 4,076,348 by Allison, U.S. Pat. No. 3,907,360 by Czarnowski, U.S. Pat. No. 3,399,925 by Levy and U.S. Pat. No. 3,117,816 by De Sena. In each instance, the legs are foldable relative to the seat panel for storage, however a separate hinge structure is required for collapsing the work support independently of the legs. The resulting structures are a relatively complex number of parts to collapse a relatively simple object.

Furthermore, known prior art artist benches are typically limited to a single operating position for the artist.

SUMMARY OF THE INVENTION

According to one aspect of the invention there is provided a foldable artist bench comprising:

a seat panel comprising an upper seating surface and an opposing lower surface spanning in a longitudinal direction between a first end and a second end, the upper seating surface being arranged to support a person seated thereon;

a first leg pivotally coupled to the seat panel adjacent to the first end;

a second leg pivotally coupled to the seat panel adjacent to the second end;

the first and second legs being pivotal relative to the seat panel between a working position in which the first and second legs extend outwardly from the lower surface of the seat panel so as to be substantially perpendicular to the longitudinal direction of the seat panel and a storage position in which the first and second legs span parallel to and alongside the lower surface of the seat panel; and a work support supported on the first leg in fixed relation to the first leg so as to be pivotal together with the first leg between the working position in which the work support extends upwardly beyond the upper seating surface of the seat panel adjacent to the first end of the seat panel and the storage position in which the work support is substantially parallel to the seat panel.

By providing a work support which is integral with the first leg, a common hinge structure is provided for pivoting both the work support and the first leg together to simplify the folding mechanism while still permitting the bench to be folded flat in storage. When further combined with a second leg which is spaced inwardly from the end of the seat panel, the common panel of the work support and the first leg can be used in multiple operating positions. The multiple positions include supporting the seat panel in an upright orientation with the work support being oriented in either upright or transverse orientations at the top end of the upright seat panel. In this instance, the artist bench can also be used in a standing orientation functioning as an easel in addition to the normal use as a seated bench.

The first leg and the work support may comprise a common panel such that the first leg and the work support lie in a substantially common plane with one another in both the working position and the storage position.

Preferably the second leg is oriented relative to the seat panel in the working position such that the second end of the seat panel and the second leg are arranged to support the seat panel in an upright orientation with said common panel in the working position at an inclination from horizontal when the second end of the seat panel and the second leg are engaged on a horizontal supporting surface. In this instance, the second end of the seat panel may protrude outwardly in the longitudinal direction beyond the second leg.

Preferably the second leg is also oriented relative to the seat panel in the working position of the second leg such that the second leg is arranged to support the seat panel in an upright orientation with the first end of the seat panel defining a work support ledge protruding outwardly from the work support when the first leg is in the storage position in said upright orientation of the seat panel. In this instance, the work support ledge may be located adjacent a bottom free end of the second leg.

Each of the first and second legs may further include a protruding element supported thereon which protrudes outwardly in the longitudinal direction in the working position and which depends downwardly from the seat panel in the storage position so as to be arranged to support the seat panel in a substantially horizontal orientation thereon when the protruding elements are supported on a horizontal supporting surface.

The second leg may also be oriented relative to the seat panel in the working position of the second leg such that the second leg is arranged to support the seat panel in an upright orientation and the first end of the seat panel may define a work support ledge protruding outwardly from the work support when the first leg is in the storage position in said upright orientation of the seat panel.

A tool support ledge may also be provided to protrude from the upper seating surface of the seat panel at a location spaced longitudinally inward from the work support ledge formed by the first end of the seat panel.

The first leg and the work support may comprise a common panel such that the first leg and the work support lie in a substantially common plane with one another in both the working position and the storage position. In this instance the second end of the seat panel and the second leg may be arranged to support said common panel in the storage position at an inclination from vertical when the second end of the seat panel and the second leg are engaged on a horizontal supporting surface. The second end of the seat panel may protrude outwardly in the longitudinal direction beyond the second leg in this instance also.

A first gusset member and a second gusset member may also be provided for supporting the panels in the working position. Each gusset member is preferably supported for pivotal movement relative to the seat panel between the working position in which the gusset member is connected between the seat panel and a respective one of the leg members in perpendicular relation thereto and the storage position in which the gusset member is parallel to and alongside the seat panel.

Preferably each gusset member is coupled to the seat panel by a respective hinge.

Preferably the first and second gusset members and the first and second legs are substantially co-planar with one another in the storage position.

In this instance, each of the first and second legs may comprise a panel including an opening formed therein which receives the respective gusset member therein in the storage position.

According to another aspect of the present invention there is provided a foldable artist bench comprising:

a seat panel comprising an upper seating surface and an opposing lower surface spanning in a longitudinal direction between a first end and a second end, the upper seating surface being arranged to support a person seated thereon;

a first leg pivotally coupled to the seat panel adjacent to the first end;

a second leg pivotally coupled to the seat panel adjacent to the second end;

the first and second legs being pivotal relative to the seat panel between a working position in which the first and second legs extend outwardly from the lower surface of the seat panel so as to be substantially perpendicular to the longitudinal direction of the seat panel and a storage position in which the first and second legs span parallel to and alongside the lower surface of the seat panel; and a work support supported on the first leg in fixed relation to the first leg so as to be pivotal together with the first leg between the working position in which the work support extends upwardly beyond the upper seating surface of the seat panel adjacent to the first end of the seat panel and the storage position in which the work support is substantially parallel to the seat panel;

the second leg being oriented relative to the seat panel in the working position such that the second end of the seat panel and the second leg are arranged to support the seat panel in an upright orientation with said common panel in the working position at an inclination from horizontal when the second end of the seat panel and the second leg are engaged on a horizontal supporting surface.

According to a further aspect of the present invention there is provided a foldable artist bench comprising:

a seat panel comprising an upper seating surface and an opposing lower surface spanning in a longitudinal direction between a first end and a second end, the upper seating surface being arranged to support a person seated thereon;

a first leg pivotally coupled to the seat panel adjacent to the first end;

a second leg pivotally coupled to the seat panel adjacent to the second end;

the first and second legs being pivotal relative to the seat panel between a working position in which the first and second legs extend outwardly from the lower surface of the seat panel so as to be substantially perpendicular to the longitudinal direction of the seat panel and a storage position in which the first and second legs span parallel to and alongside the lower surface of the seat panel; and a work support supported on the first leg in fixed relation to the first leg so as to be pivotal together with the first leg between the working position in which the work support extends upwardly beyond the upper seating surface of the seat panel adjacent to the first end of the seat panel and the storage position in which the work support is substantially parallel to the seat panel;

the second leg being oriented relative to the seat panel in the working position of the second leg such that the second leg is arranged to support the seat panel in an upright orientation and wherein the first end of the seat panel defines a work support ledge protruding outwardly from the work support when the first leg is in the storage position in said upright orientation of the seat panel.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 2:
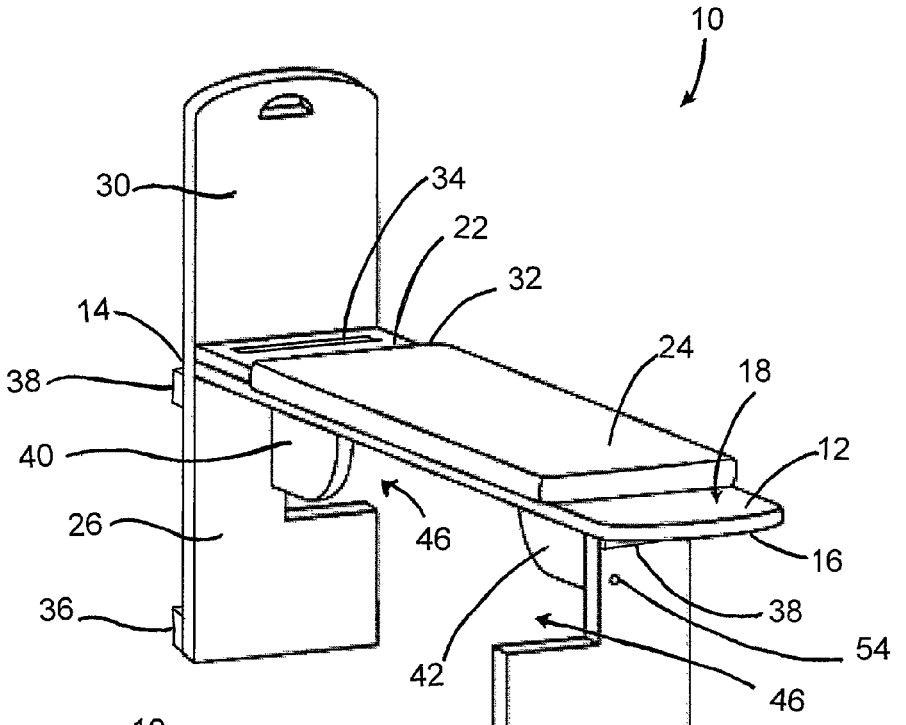
FIG. 2 is an alternative perspective view of the artist bench in the working position according to the first mode of operation of FIG. 1.

Referring to the accompanying figures, there is illustrated an artist bench generally indicated by reference numeral 10. The bench 10 is foldable between a storage position and a working position in which the configuration of the bench in the working position permits various modes of operation as described in further detail below.

The bench generally comprises a seat panel 12 which is a flat, rectangular and rigid panel and which is elongate in a longitudinal direction extending between a first end 14 and a second end 16. An upper seating surface 18 spans in the longitudinal direction and is suitably arranged for supporting a person seated thereon opposite a lower surface 20 therebelow.

The seat panel 12 supports an auxiliary panel 22 mounted in fixed relation parallel and along side the upper surface for mounting a seat pad 24 on the upper seating surface of the seat panel. The auxiliary panel 22 spans from the first end to an opposing end in proximity to but spaced inwardly from the second end of the seat panel.

The seat pad 24 is supported on the auxiliary panel to be centered in the longitudinal direction relative to the seat panel. In particular, the pad is spaced inwardly from the first ends of the seat panel and auxiliary panel and spans longitudinally to the opposing end of the auxiliary panel so as to be spaced inwardly from the second end of the seat panel 12. A portion of the upper surface of the auxiliary panel 22 thus remains exposed where it extends beyond the first end of the pad 24 towards the first end of the seat panel therebelow. Similarly, the second end of the seat panel protrudes in the longitudinal direction beyond the ends of both the auxiliary panel and the seat pad. The seat pad spans the full width of the seat panel in the lateral direction which is perpendicular to the longitudinal direction.

A first leg 26 is pivotally coupled to the first end of the seat panel 12. The first leg also comprises a rectangular rigid panel which has the same width as the seat in the lateral direction. The first leg is pivotal between the working position in which the first leg is perpendicular to the seat panel so as to depend downwardly and outwardly from the lower surface of the seat panel and the storage position in which the first leg is parallel and flat along side the lower surface of the seat panel.

A second leg 28 is pivotally coupled to the lower surface of the seat panel adjacent to but spaced inwardly from the second end of the seat panel such that the second end of the seat panel protrudes longitudinally beyond the second leg. The second leg is also a rectangular rigid panel spanning the width of the seat panel. The second leg is also pivotal between a working position perpendicular to the seat panel and a storage position parallel to the seat panel as described above with regard to the first leg.

The two legs are pivoted inwardly towards one another in the longitudinal direction from the working position to the storage position such that the bottom free ends of the two legs are positioned adjacent one another at a central location along the seat panel in the longitudinal direction in the storage position. The first and second legs are accordingly coplanar with one another along the lower surface of the seat panel in the storage position.

The bench 10 further includes a work support 30 which also comprises a rigid rectangular panel. The work support 30 is integral with the first leg so as to be coplanar with one another and so as to be formed of a single, unitary, integral, and seamless common panel of material. The work support 30 and the first leg 26 remain fixed in orientation with one another as they are pivoted together relative to the seat panel between the working position and the storage position. In the working position, the work support is accordingly perpendicular to the seat panel so as to extend upwardly therefrom beyond the upper surface at the first end of the seat panel. In the storage position, the work support is coplanar with the legs so as to be parallel to the seat panel and so as to extend longitudinally outward beyond the first end of the seat panel.

In the working position, the seat pad is spaced longitudinally inward from the work support so that a portion of the first end of the auxiliary panel remains exposed between the seat pad and the work support. A work support ledge 32 is mounted on the auxiliary panel so as to span in a lateral direction across a full width of a seat panel perpendicular to the longitudinal direction and so as to protrude upwardly and outwardly from the upper seating surface along the first edge of the seat pad spaced longitudinally inward from the first end of the seat panel. In this manner, a work piece such as a canvas or a drawing board can be supported on the work support surface by engaging the bottom edge of the work piece against the work support ledge 32 with the work piece extending at an upward and outward incline towards an upper end supported on the work support.

The exposed portion of the auxiliary panel 22 between the seat pad and the work support also includes a groove 34 formed therein which spans a majority of the width of the panel in the lateral direction. The groove 34 is a recessed channel of suitable size for receiving various artist tools therein including pencils or brushes and the like for example. The groove can also be used as an auxiliary support for the bottom edge of a work piece if desired.

Figure 1:
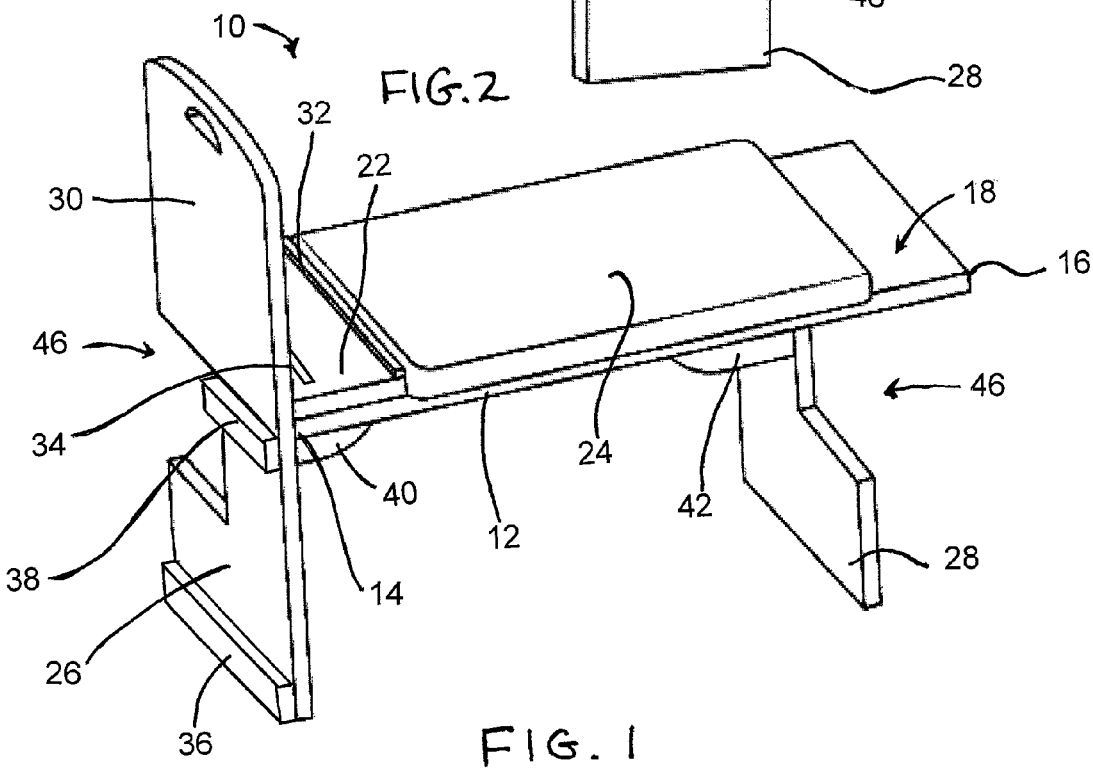
FIG. 1 is a perspective view of the artist bench in a working position according to a first mode of operation.
Figures 3, 4, 5:
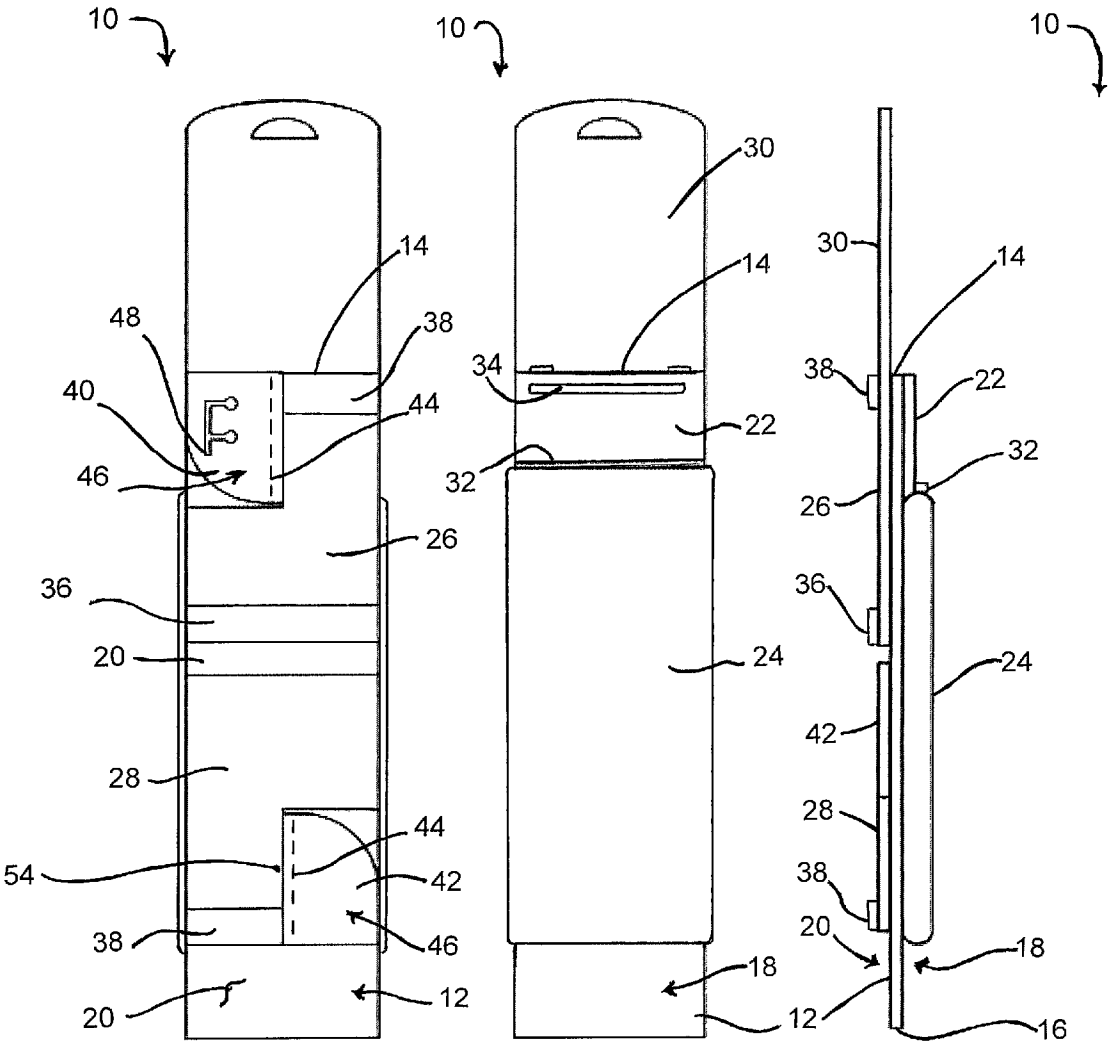
FIG. 3 is a bottom plan view of the bench in the storage position.
FIG. 4 is a top plan view of the bench in the storage position.
FIG. 5 is a side elevational view of the bench in the storage position.

As described herein, the bench is operable in three modes of operation with the second leg 28 being in the working position in each instance. In the first mode as shown in FIGS. 1 and 2, the seat panel is used as a bench so as to be substantially horizontal in orientation spaced above a horizontal supporting surface when both legs are in the working position extending vertically downward to engage the supporting surface at the bottom free ends thereof.

Figure 6:
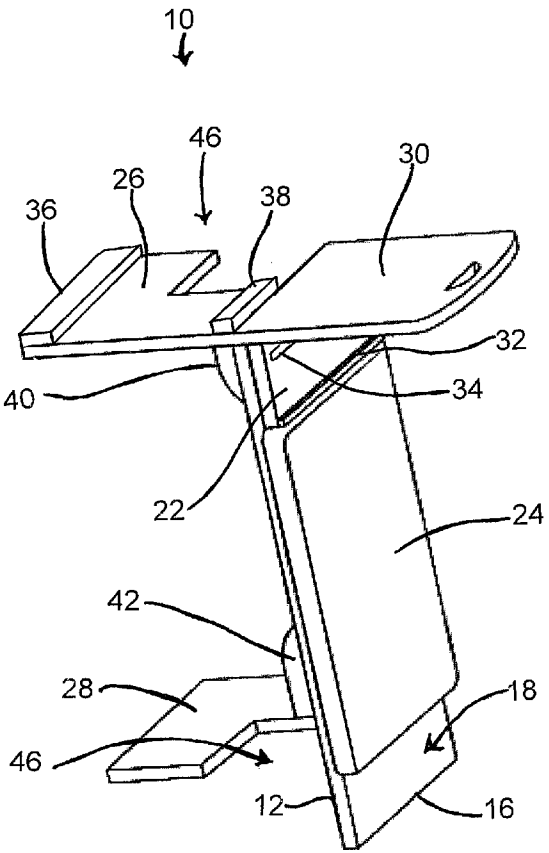
FIG. 6 is a perspective view of the bench in the working position according to a second mode of operation.
Figure 9:
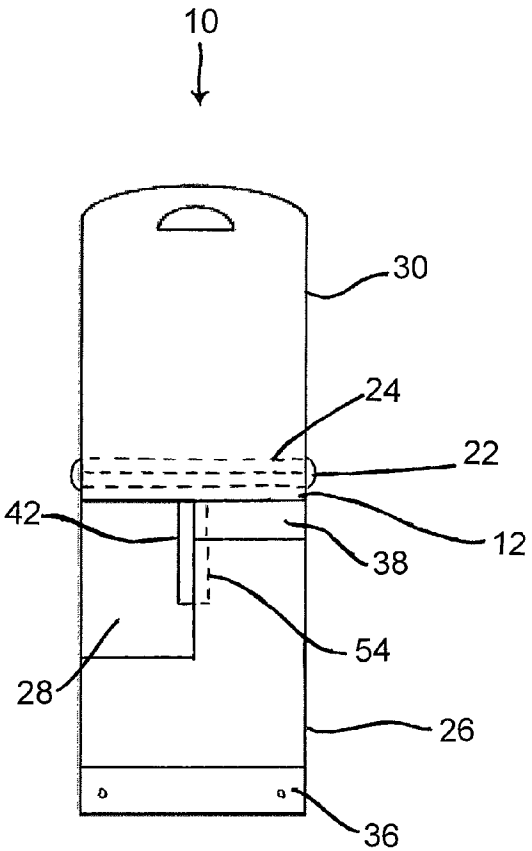
FIG. 9 is an end elevational view of the bench in the working position according to the first mode of operation of FIGS. 1 and 2.
Figure 8:
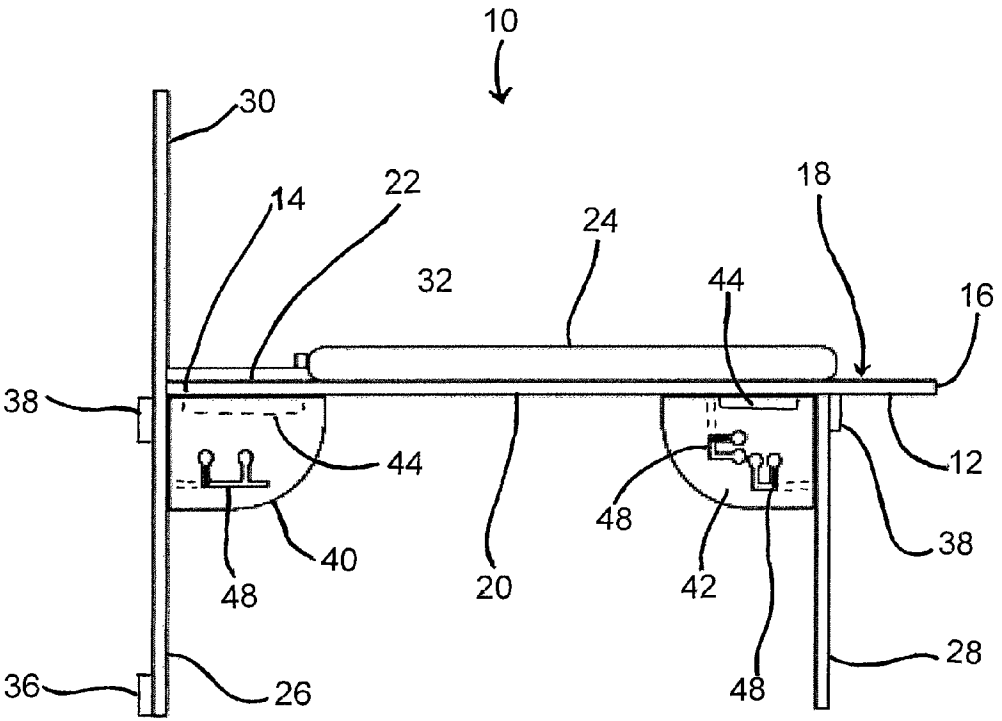
FIG. 8 is a side elevational view of the bench in the working position according to the first mode of operation of FIGS. 1 and 2.
Figure 10:
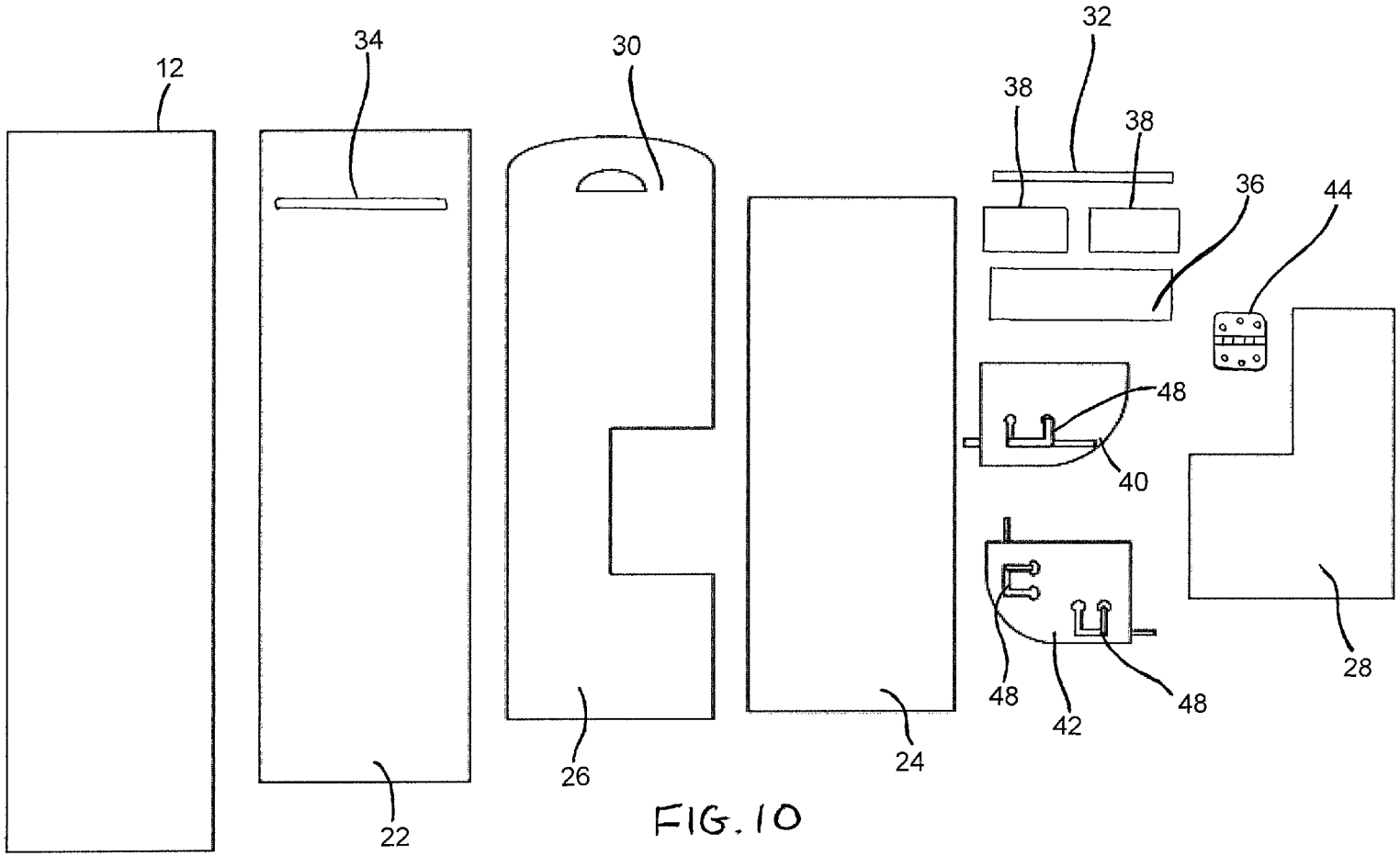
FIG. 10 is an exploded view of the various components of the bench shown disassembled.

With the second leg remaining in the working position, the bench can also be rotated so that the seat panel is in a generally upright orientation as shown in FIG. 6. Due to the second leg being spaced inwardly from the second end of the seat panel so that the second end of the seat panel protrudes beyond the leg, a support plane is defined between the second end of the seat and the bottom free end of the second leg in the working position which is oriented at an angle to the seat panel and the common panel of the first leg and work support in the working position. Accordingly, engaging the bottom free end of the second leg and the second end of the seat panel onto a horizontal supporting surface results in the seat panel being supported at an upright inclination so as to be slightly angularly offset from vertical. In the second mode, the first leg remains in the working position such that the outer side of the common panel forming the first leg and work support functions as a common work support which is inclined slightly from horizontal to extend at an upward inclination from the bottom free end of the first leg for suitably supporting a work piece thereon at a proper orientation for a person standing.

Figure 7:
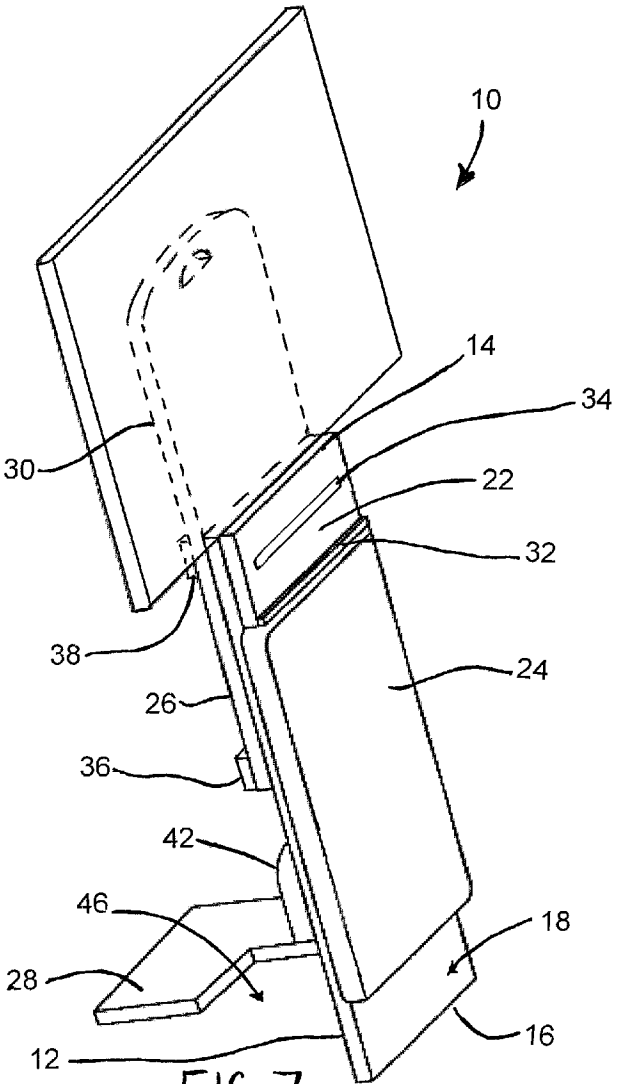
FIG. 7 is a perspective view of the bench in the working position according to a third mode of operation.

According to a third mode of operation as shown in FIG. 7, the second leg in the working position may be used similarly to the second mode to support the seat panel at an upright inclination, but the first leg and work support in this instance are pivoted into the storage position so as to be substantially parallel to the upright inclination of the seat panel. The work support thus extends upwardly parallel to the seat panel above the first end of the seat panel so as to also function for supporting a work piece in the third mode of operation, in this instance, the first end of the seat panel and the auxiliary panel define a ledge protruding outward from the plane of the work support upon which a bottom edge of a work piece may be engaged so that the bench functions as an easel in the third mode.

To provide optimal support for a work piece in the second mode, a protruding element 36 may be located at the bottom free end of the first leg on the outer side thereof to fully span the width of the leg in the lateral direction. The protruding element 36 protrudes outward in the longitudinal direction of the seat panel in the working position of the first leg to define a work support ledge or shoulder upon which the bottom edge of a work piece can be engaged when the work piece lies on the outer side of the common panel of the first leg and the work support. When the common panel is pivoted to the storage position, the protruding element 36 is oriented to protrude downwardly and outwardly from the plane of the lower surface of the seat panel.

Each of the first and second legs also includes a protruding element 38 on the outer side thereof to project outward from the plane of the leg in the longitudinal direction when the legs are each positioned in their respective working position. The protruding elements 38 are located adjacent to the seat panel so as to be near in elevation to the seat panel at the top end of the legs in the working position. When the legs are pivoted into the storage position, the protruding elements 38 are oriented to protrude downwardly out of the plane of the lower surface of the seat panel similarly to the protruding element 36 such that all of the protruding elements 36 and 38 terminate in a common support plane oriented parallel to the seat panel in the storage position and such that the seat panel remain horizontal when stacked on a horizontal supporting surface or when stacked on other benches of like configuration.

The bench further includes a first gusset member 40 and a second gusset member 42 for providing support to the first and second legs respectively in the working position. Each of the gusset members comprises a flat rigid panel having two working edges oriented perpendicularly to one another such that one of the edges abuts the lower surface of the seat panel and one of the edges abuts the inside surface of the respective leg in the working position. In the working position, the panel of each gusset member is oriented perpendicularly to both the seat panel and the respective legs while being positioned substantially centrally in the lateral direction such that the gusset members are coplanar with one another in the working position.

Hinges 44 couple each gusset member to the lower surface of the seat panel such that the gusset members are each pivotal between the respective working position and a storage position in which the gusset member is folded flat against the seat so as to be parallel thereto. The overall height of the gusset member is substantially equal to or less than the width in the lateral direction between the respective hinge and the outer side edge of the seat panel such that the gusset member does not protrude laterally outward beyond the seat panel when folded flat into the storage position. In the illustrated embodiment, when the hinges are centered in the lateral direction, the height of each gusset member corresponds approximately to half of the width of the seat panel in the lateral direction.

Each of the legs includes an opening 46 formed therein to extend from a lateral center of the leg outward to one side adjacent the top end of the leg for alignment with the respective gusset member when both the leg and the gusset member are folded into the storage position. Accordingly, each leg is substantially L-shaped including one side portion extending downward from the seat panel and one bottom portion spaced below the seat panel in the working position. By arranging the openings 46 in the legs to accommodate the size and shape of the gusset members, the gusset members can be received within the opening in the legs respectively when folded into the storage position such that the gusset members and the legs are substantially coplanar in the folded storage position.

Figure 11:
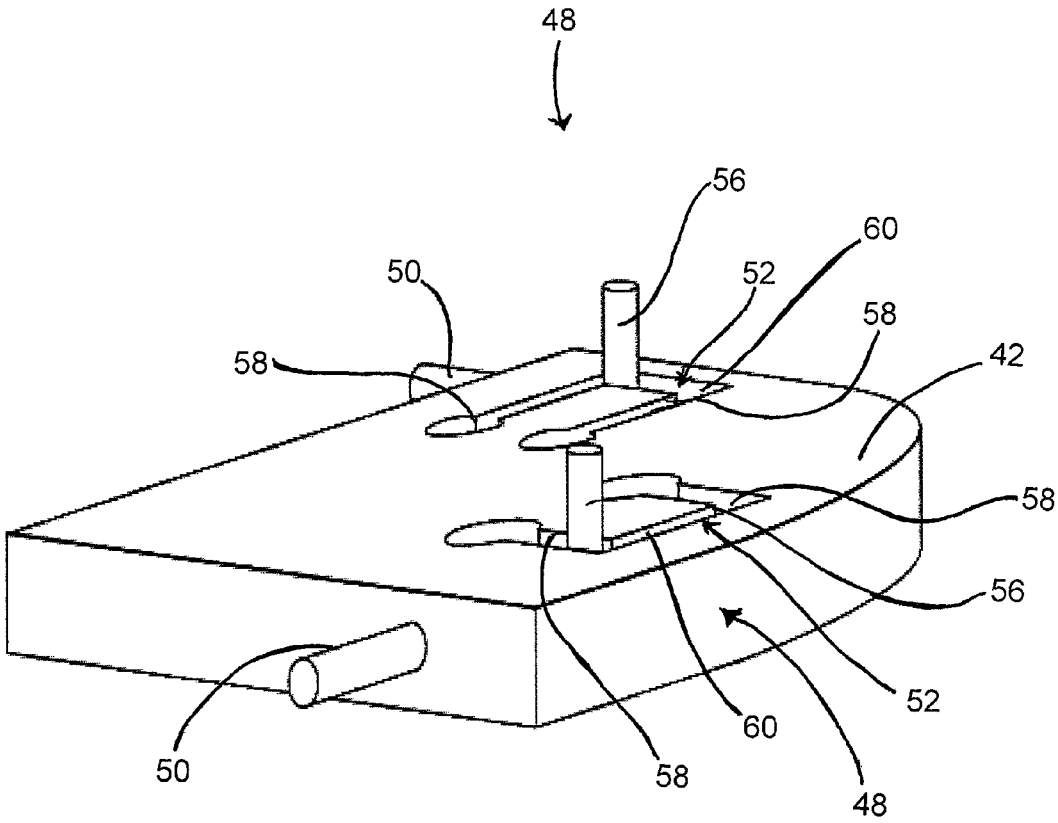
FIG. 11 is a perspective view of one of the gusset members.

As best shown in FIG. 11, each gusset member includes at least one latch 48 coupled thereto in the form of a sliding bolt 50 mounted within a respective recessed channel 52 on the gusset member which is open to a side of the panel body forming the gusset member. An internal bore connects the channel 52 to a corresponding side edge of the panel body. Each sliding bolt with longitudinally slidable with the respective channel and bore between a released position fully retracted into the body of the gusset member and a latching position in which bolt 50 protrudes from the body of the gusset member to be received within a respective socket 54 on the corresponding leg or seat panel of the bench with which the bolt is associated to retain the gusset member coupled between the seat panel and the respective leg in the working position. While in the latched position, each latch assists to retain the bench in the working position. Alternatively in the released positions of the latches the gusset members are freely foldable to the storage position which then allows the legs to then be folded into the storage position.

Each latch 48 further includes a handle portion 56 protruding from an inner end of the bolt 50 at right angles to the longitudinal direction of the bolt. The outer end of the bolt may be readily separable from the inner end locating the handle portion 56 by an intermediate threaded connection between the inner and outer ends to assist in mounting of the bolt components within the respective channel and bore recessed into the panel body of the gusset member.

Each bolt 50 is rotatable within the respective channel 52 about its longitudinal axis such that the handle portion is rotatable therewith from a first orientation protruding out of the channel perpendicularly to the panel body of the gusset member for grasping by the user and a second orientation fully recessed into the body of the gusset member. The channel 52 includes a pair of auxiliary portions 58 oriented at right angles to a main longitudinal portion 60 of the channel to receive the handle portion 56 therein in the second orientation when the sliding bolt is displaced into either one of the latched or released positions respectively.

In the illustrated embodiment, the first gusset member 40 includes only a single latch 48 for engagement into a corresponding socket in the leg 26. The second gusset member 42 includes a first latch 48 for engagement into a corresponding socket in the leg 28 and a second latch 48 for engagement into a corresponding socket in a bottom side of the seat panel for additional structural support.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A foldable artist bench comprising:

a seat panel comprising an upper seating surface and an opposing lower surface spanning in a longitudinal direction between a first end and a second end, the upper seating surface being arranged to support a person seated thereon;

a first leg pivotally coupled to the seat panel adjacent to the first end;

a second leg pivotally coupled to the seat panel adjacent to the second end;

the first and second legs being pivotal relative to the seat panel between a working position in which the first and second legs extend outwardly from the lower surface of the seat panel so as to be substantially perpendicular to the longitudinal direction of the seat panel and a storage position in which the first and second legs span parallel to and alongside the lower surface of the seat panel; and a work support supported on the first leg in fixed relation to the first leg so as to be pivotal together with the first leg between the working position in which the work support extends upwardly beyond the upper seating surface of the seat panel adjacent to the first end of the seat panel and the storage position in which the work support is substantially parallel to the seat panel.

2. The bench according to claim 1 wherein the first leg and the work support comprise a common panel such that the first leg and the work support lie in a substantially common plane with one another in both the working position and the storage position.

3. The bench according to claim 2 wherein the second leg is oriented relative to the seat panel in the working position such that the second end of the seat panel and the second leg are arranged to support the seat panel in an upright orientation with said common panel in the working position at an inclination from horizontal when the second end of the seat panel and the second leg are engaged on a horizontal supporting surface.

4. The bench according to claim 3 wherein the second end of the seat panel protrudes outwardly in the longitudinal direction beyond the second leg.

5. The bench according to claim 1 wherein the second leg is oriented relative to the seat panel in the working position such that the second leg is arranged to support the seat panel in an upright orientation and wherein the first leg includes a work support ledge supported protruding outwardly in the longitudinal direction therefrom in the working position so as to be arranged to support a work piece on the first leg in said upright orientation of the seat panel.

6. The bench according to claim 5 wherein the work support ledge is located adjacent a bottom free end of the second leg.

7. The bench according to claim 1 wherein each of the first and second legs includes a protruding element supported thereon which protrudes outwardly in the longitudinal direction in the working position and which depends downwardly from the seat panel in the storage position so as to be arranged to support the seat panel in a substantially horizontal orientation thereon when the protruding elements are supported on a horizontal supporting surface.

8. The bench according to claim 1 wherein the second leg is oriented relative to the seat panel in the working position of the second leg such that the second leg is arranged to support the seat panel in an upright orientation and wherein the first end of the seat panel defines a work support ledge protruding outwardly from the work support when the first leg is in the storage position in said upright orientation of the seat panel.

9. The bench according to claim 8 wherein there is provided a tool support ledge protruding from the upper seating surface of the seat panel spaced longitudinally inward from the work support ledge formed by the first end of the seat panel.

10. The bench according to claim 9 wherein the first leg and the work support comprise a common panel such that the first leg and the work support lie in a substantially common plane with one another in both the working position and the storage position and wherein the second end of the seat panel and the second leg are arranged to support said common panel in the storage position at an inclination from vertical when the second end of the seat panel and the second leg are engaged on a horizontal supporting surface.

11. The bench according to claim 10 wherein the second end of the seat panel protrudes outwardly in the longitudinal direction beyond the second leg.

12. The bench according to claim 1 wherein there is provided a first gusset member and a second gusset member, each gusset member being supported for pivotal movement relative to the seat panel between the working position in which the gusset member is connected between the seat panel and a respective one of the leg members in perpendicular relation thereto and the storage position in which the gusset member is parallel to and alongside the seat panel.

13. The bench according to claim 12 wherein each gusset member is coupled to the seat panel by a respective hinge.

14. The bench according to claim 12 wherein the first and second gusset members and the first and second legs are substantially co-planar with one another in the storage position.

15. The bench according to claim 12 wherein each of the first leg and the second leg comprises a panel including an opening formed therein which receives the respective gusset member therein in the storage position.

16. A foldable artist bench comprising:

a seat panel comprising an upper seating surface and an opposing lower surface spanning in a longitudinal direction between a first end and a second end, the upper seating surface being arranged to support a person seated thereon;

a first leg pivotally coupled to the seat panel adjacent to the first end;

a second leg pivotally coupled to the seat panel adjacent to the second end;

the first and second legs being pivotal relative to the seat panel between a working position in which the first and second legs extend outwardly from the lower surface of the seat panel so as to be substantially perpendicular to the longitudinal direction of the seat panel and a storage position in which the first and second legs span parallel to and alongside the lower surface of the seat panel; and a work support supported on the first leg in fixed relation to the first leg so as to be pivotal together with the first leg between the working position in which the work support extends upwardly beyond the upper seating surface of the seat panel adjacent to the first end of the seat panel and the storage position in which the work support is substantially parallel to the seat panel;

the second leg being oriented relative to the seat panel in the working position such that the second end of the seat panel and the second leg are arranged to support the seat panel in an upright orientation with the work support in the working position at an inclination from horizontal when the second end of the seat panel and the second leg are engaged on a horizontal supporting surface.

17. A foldable artist bench comprising:

a seat panel comprising an upper seating surface and an opposing lower surface spanning in a longitudinal direction between a first end and a second end, the upper seating surface being arranged to support a person seated thereon;

a first leg pivotally coupled to the seat panel adjacent to the first end;

a second leg pivotally coupled to the seat panel adjacent to the second end;

the first and second legs being pivotal relative to the seat panel between a working position in which the first and second legs extend outwardly from the lower surface of the seat panel so as to be substantially perpendicular to the longitudinal direction of the seat panel and a storage position in which the first and second legs span parallel to and alongside the lower surface of the seat panel; and a work support supported on the first leg in fixed relation to the first leg so as to be pivotal together with the first leg between the working position in which the work support extends upwardly beyond the upper seating surface of the seat panel adjacent to the first end of the seat panel and the storage position in which the work support is substantially parallel to the seat panel;

the second leg being oriented relative to the seat panel in the working position of the second leg such that the second leg is arranged to support the seat panel in an upright orientation and wherein the first end of the seat panel defines a work support ledge protruding outwardly from the work support when the first leg is in the storage position in said upright orientation of the seat panel.

* * * * *